US011448024B2

(12) United States Patent
Ringgenberg

(10) Patent No.: US 11,448,024 B2
(45) Date of Patent: Sep. 20, 2022

(54) RETRIEVABLE PACKER WITH DELAYED SETTING

(71) Applicant: Halliburton Energy Services, Inc., Houston, TX (US)

(72) Inventor: Paul David Ringgenberg, Carrollton, TX (US)

(73) Assignee: Halliburton Energy Services. Inc., Houston, TX (US)

( * ) Notice: Subject to any disclaimer, the term of this patent is extended or adjusted under 35 U.S.C. 154(b) by 130 days.

(21) Appl. No.: 17/149,452

(22) Filed: Jan. 14, 2021

(65) Prior Publication Data

US 2022/0220817 A1 Jul. 14, 2022

(51) Int. Cl.
*E21B 23/00* (2006.01)

(52) U.S. Cl.
CPC ..... *E21B 23/006* (2013.01)

(58) Field of Classification Search
CPC ..... E21B 23/006; E21B 17/07; E21B 17/073
See application file for complete search history.

(56) References Cited

U.S. PATENT DOCUMENTS 2,918,259 A * 12/1959 Bus, Sr. ..... E21B 17/07 285/402
2,931,438 A * 4/1960 Thompson ..... E21B 17/07 166/243
3,354,950 A * 11/1967 Hyde ..... E21B 47/001 285/302
4,610,300 A 9/1986 Mullins, II et al.
4,722,392 A * 2/1988 Proctor ..... E21B 43/04 166/240

(Continued)

FOREIGN PATENT DOCUMENTS

EP 0441021 A1 8/1991
EP 2619402 B1 10/2017
WO 2016089417 A1 6/2016

OTHER PUBLICATIONS

Foreign Communication from Related Application—International Search Report and Written Opinion of the Internationa Searching Authority, International Application No. PCT/US2021/013986, dated Oct. 13, 2021, 10 pages.

(Continued)

*Primary Examiner* — D. Andrews
*Assistant Examiner* — Ronald R Runyan
(74) *Attorney, Agent, or Firm* — Conley Rose, P.C.; Rodney B. Carroll

(57) ABSTRACT

A downhole tool activation assembly for prevention of activation from rig heave on a floating rig comprising a block release with a release feature. The release feature includes a release chamber, an activation chamber, and a fluid stop that retains a traveling block in a first position. A traveling block comprised of a plurality of drag blocks and drag block springs is configured to retain the traveling block to a position along an inner surface of a casing. The block release moves to a release position when the release feature is activated. The traveling block moves axially along a block mandrel with a block lug traveling within a j-slot. The j-slot on the block mandrel includes a run-in slot, a motion slot, and an activating slot configured to transfer the block lug to the next slot. The activating slot is configured to move the traveling block to an activating position.

20 Claims, 8 Drawing Sheets

(56) References Cited

U.S. PATENT DOCUMENTS

| | | | | |
|---|---|---|---|---|
| 4,928,762 | A | 5/1990 | Mamke | |
| 8,733,447 | B2 | 5/2014 | Mouton et al. | |
| 8,931,563 | B2 * | 1/2015 | Holtet | E21B 17/021 166/368 |
| 9,523,252 | B2 * | 12/2016 | White | E21B 23/00 |
| 9,650,854 | B2 | 5/2017 | Devarajan et al. | |
| 10,246,968 | B2 | 4/2019 | Budde et al. | |
| 10,428,610 | B2 | 10/2019 | Bergeron et al. | |
| 2001/0045281 | A1 | 11/2001 | Foster et al. | |
| 2017/0183923 | A1 | 6/2017 | Bansal et al. | |
| 2020/0063515 | A1 | 2/2020 | Fairweather et al. | |

OTHER PUBLICATIONS

"PosiTest: Retrievable compression packer," Schlumberger, 2014, 2 pages.

* cited by examiner

RETRIEVABLE PACKER WITH DELAYED SETTING

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Drilling operations and well servicing operations can be performed offshore on floating platforms and drill ships. The movement of the ocean waves can cause movement of the servicing rig and subsequently the work string. The up and down movement of the work string can interfere with the activation of servicing tools lowered into the wellbore. There is a need to compensate for the movement of the work string relative to the movement of floating structure on the ocean waves while performing such operations.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
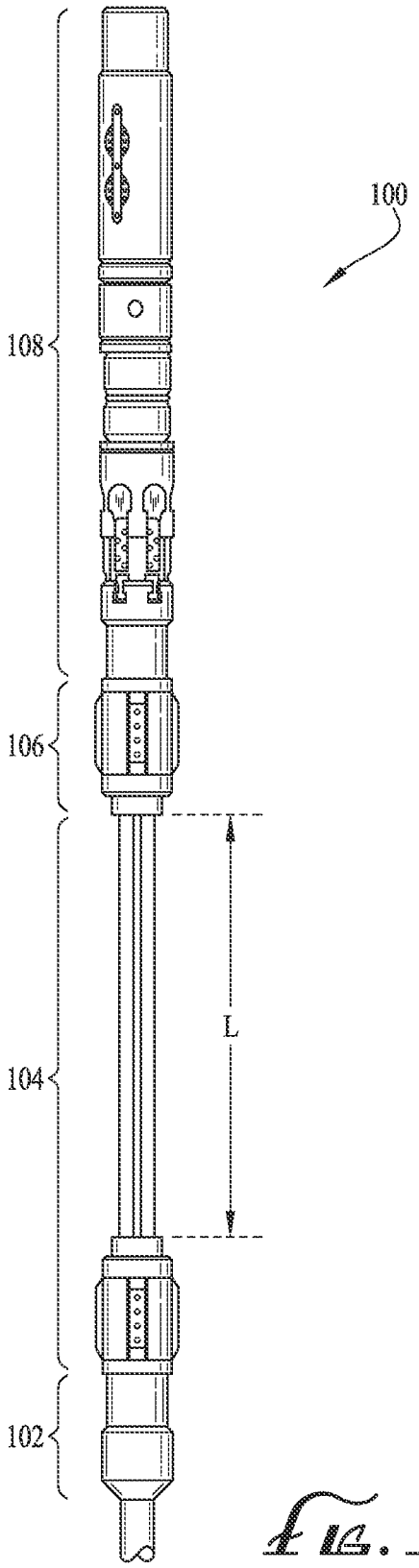
FIG. 1 is a side view drawing showing an embodiment of the downhole tool activation assembly.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Service companies routinely lower well servicing tools into the wellbore to perform treatment operations on oil and gas wells. The typical well servicing tools can include retrievable service packers, reservoir testing tools, and perforating equipment. These well servicing tools can be attached to a work string such as coil tubing, production tubing, or drill pipe to be lowered into the wellbore. Well servicing tools can require work string manipulation (e.g., raising, lowering, or rotation) to activate, perform the operation, and deactivate for retrieval from the well. Operations deep within the wellbore can prevent rotation of the tool string to actuate or manipulate the well servicing tools. In some cases, control lines, cables, or umbilical can be attached to the work string creating an unsafe environment on the rig floor for rotation of the work string.

One solution of activation of well servicing tools without rotation is a rupture disk. A rupture disk with an atmospheric chamber activate a tool with pressure applied down the work string or within the wellbore annulus. However, open perforations at the bottom of the well will prevent applying pressure down the annulus. A burst disk within the work string would require additional equipment to close off the work string or additional intervention from surface causing unwanted delays and equipment. The hydrostatic pressure of the wellbore can rupture the burst disk, but the disk would have to rupture well before the well servicing tools reach target depth.

Another solution to activate well servicing tools can be the up and down manipulation of the work string. The activation mechanism can be an automatic j-slot that allows the tool to active by raising and lowering the work string one or more times. However, the wave motion on the floating rig, also called rig heave, can cause the premature activation of the well servicing tools. In the worst case, the rig heave can cause a service tool to activate and deactivate repeatedly while being lowered into the wellbore risking damage to the well service tool. A well servicing tool activation method for floating rigs and open perforations is needed.

The solution for activating a well servicing tool without rotation or rupture disks on a floating rig can include a setting mechanism that requires the work string to be manipulated a length greater than the rig heave. In addition, the setting mechanism can be deactivated by a second mechanism until the well servicing tool reaches a predetermined depth in the wellbore.

Turning now to FIG. 1, a downhole tool activation assembly 100 is described. A downhole tool activation assembly 100 can include a block release 102, a traveling block 104, a lock release 106, and a downhole tool 108. The block release 102 can retain the traveling block 104 in the run-in position until the block release 102 is activated. The block release 102 can be activated by well hydrostatic pressure. The traveling block 104 can include a set of drag blocks to retain its position in the well when released by the block release 102 and a block mandrel with a j-slot. The length of the block mandrel 130, identified by "L", can exceed the rig heave to retain the traveling block 104 in a run-in condition and prevent activation of the lock release 106. The lock release 106 can retain the downhole tool 108 in a run-in position until deactivated by the traveling block 104. The downhole tool 108 is illustrated as a retrievable packer, however it is understood that the downhole tool 108 can be a retrievable packer, permanent packer, bridge plug, circulation valve, isolation valve, downhole tester, perforating gun assembly, or any other suitable downhole tool assembly.

The function of each assembly and the method of activating a downhole tool will be more fully disclosed further hereinafter.

Figure 2:
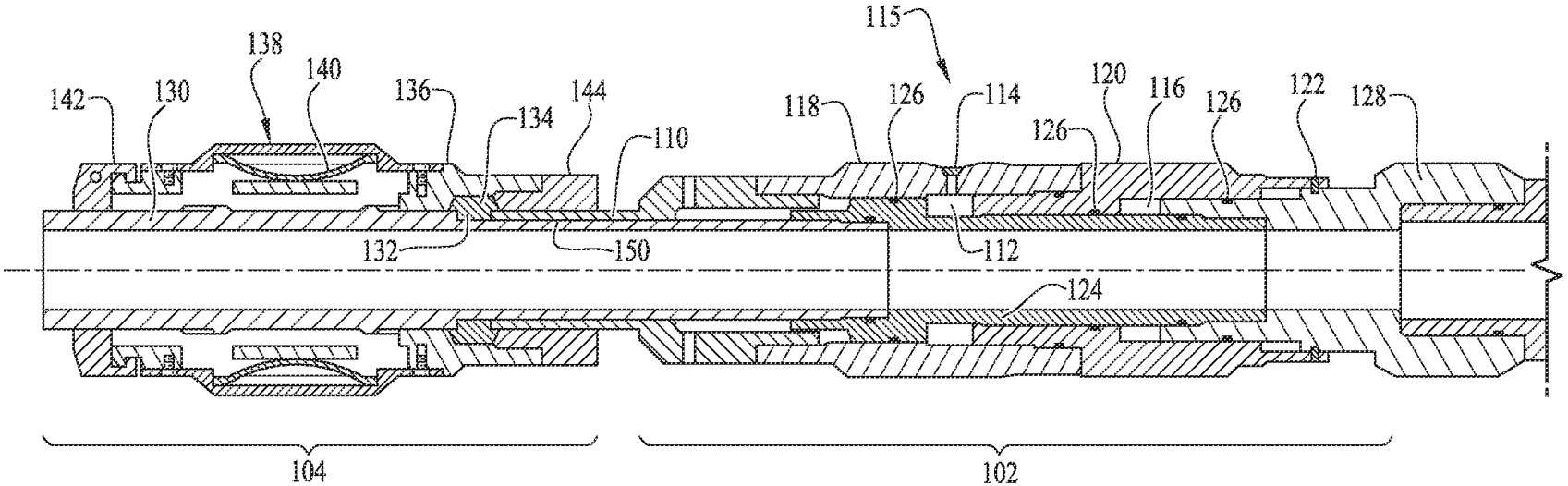
FIG. 2 is a sectional view of a traveling block and block release assembly according to an embodiment of the present invention.

Turning now to FIG. 2, the block release 102 and the traveling block 104 are described. The block release 102 can include a block lug lock 110 and a release feature 115. The release feature 115 can include a release chamber 112, a fluid stop 114, and an activation chamber 116. The block lug lock 110 retains the traveling block 104 in the run-in position as will be explained in detail herein after. The release chamber 112 and activation chamber 116 of the release feature 115 can be filled with air at atmospheric pressure and retain the block lug lock 110 in a run-in position. The release chamber 112 can be formed by an upper housing 118 threadingly connected to the block lug lock 110 and to a lower housing 120 and by a lower mandrel 124. The release chamber 112 may be sealed by one or more seals 126 and a fluid stop 114. The activation chamber 116 can be formed by a lower housing 120 threadingly connected to the upper housing 118 and attached to an end sub 128 by shear pins 122. The activation chamber 116 can be sealed by one or more seals 126 to the lower mandrel 124. The lower mandrel 124 may be threadingly connected to the end sub 128 and a block mandrel 130. In an embodiment, the fluid stop 114 can be a rupture disk, also called a burst disk, designed to break at a predetermined pressure.

The block release 102 can be moved from a run-in position to a release position by activating the release feature 115. The release feature 115 can be activated by opening the fluid stop 114 (e.g., burst disk) to allow wellbore fluid to enter the release chamber 112. In the case of a burst disk 114, the hydrostatic pressure within the wellbore increases as the downhole tool 108 is lowered on the work string. When the hydrostatic pressure equals the pressure rating of the burst disk 114, the burst disk 114 can rupture and wellbore fluid to enter the release chamber 112. The hydrostatic pressure within the release chamber 112 will create a pressure differential with the activation chamber 116. The pressure differential applied to cross-sectional area of the activation chamber 116 will generate a force to shear the shear pins 122 and push the lower housing 120, upper housing 118, and block lug lock 110 towards the end sub 128 to a second position also called the release position. The release position of the block lug lock 110 allows the traveling block 104 to move relative to the block release 102 as will be described herein after.

The traveling block 104 can include a block lug 132, a lug rotator ring 134, a block housing 136, a plurality of drag blocks 138 and drag block springs 140, a top sub 142, lug retainer 144, and a block mandrel 130. The plurality of drag blocks 138 and drag block springs 140 can be installed in individual windows radially spaced around the block housing 136. The drag block springs 140 bias the drag blocks 138 radially outward from the block housing 136 into engagement with the inner surface of the casing. The drag block housing 136 slidingly fits over the block mandrel 130. The drag block housing 136 may have an allowance fit that provides free travel over the block mandrel 130. One or more block lugs 132 may extend from a lug rotator ring 134 into a j-slot 150 formed on the block mandrel 130. The block lugs 132 can travel axially within the j-slot 150 on the block mandrel 130. The lug rotator ring 134 can rotate within the block housing 136. The lug retainer 144 is threadingly connected to the block housing 136 to retain the lug rotator ring 134. The top sub 142 is connected to the block housing 136.

In an embodiment, the release feature 115 can include a fluid stop 114 located on the lower mandrel 124. The fluid stop 114 can be a burst disk sealing engaged on the lower mandrel proximate to the release chamber 112. The hydrostatic pressure within the inside of the mandrel can rupture the burst disk (e.g., fluid stop 114) at a predetermined pressure to allow wellbore fluids to enter the release chamber 112. Although the fluid stop 114 is described as a burst disk, it is understood that the fluid stop 114 can be any removable, shiftable, or breakable fluid barrier. In an aspect, the fluid stop 114 can be a hollow breakable plug, also called a Kobe plug, sealingly connected to the lower mandrel 124 and configured to be broken by a drop bar, setting ball, pumpable plug, or wiper plug. In an aspect, the fluid stop 114 can be a shiftable sleeve sealing engaged with the lower mandrel 124 and displaced by a setting ball, pumpable plug, or wiper plug. In an aspect, the fluid stop 114 can be a removable plug composed of a dissolvable or degradable material configured to be corroded with wellbore fluids. The removable plug can also be called a dissolvable plug. In an embodiment, the block release 102 can have a plurality of fluid stops 114 of one or more configurations located on the lower mandrel 124 and/or the upper housing 118.

The release feature 115 of the block release 102 can delay the release of the traveling block 104 and subsequently the activation of the downhole tool 108. The amount of the delay can depend on the configuration of the release feature 115. In the example of a dissolvable plug or removable plug, the delay of the release may be determined by the rate of corrosion based on the material and wellbore environment. In the example of the burst disk, the delay of the release may be based on the well hydrostatic pressure and the predetermined pressure limit of the burst disk. In the example of a breakable plug or a shiftable sleeve, the delay of the release may be based on time needed for a drop bar, setting ball, or pumpable plug to travel through the work string to the release feature 115.

Figure 3:
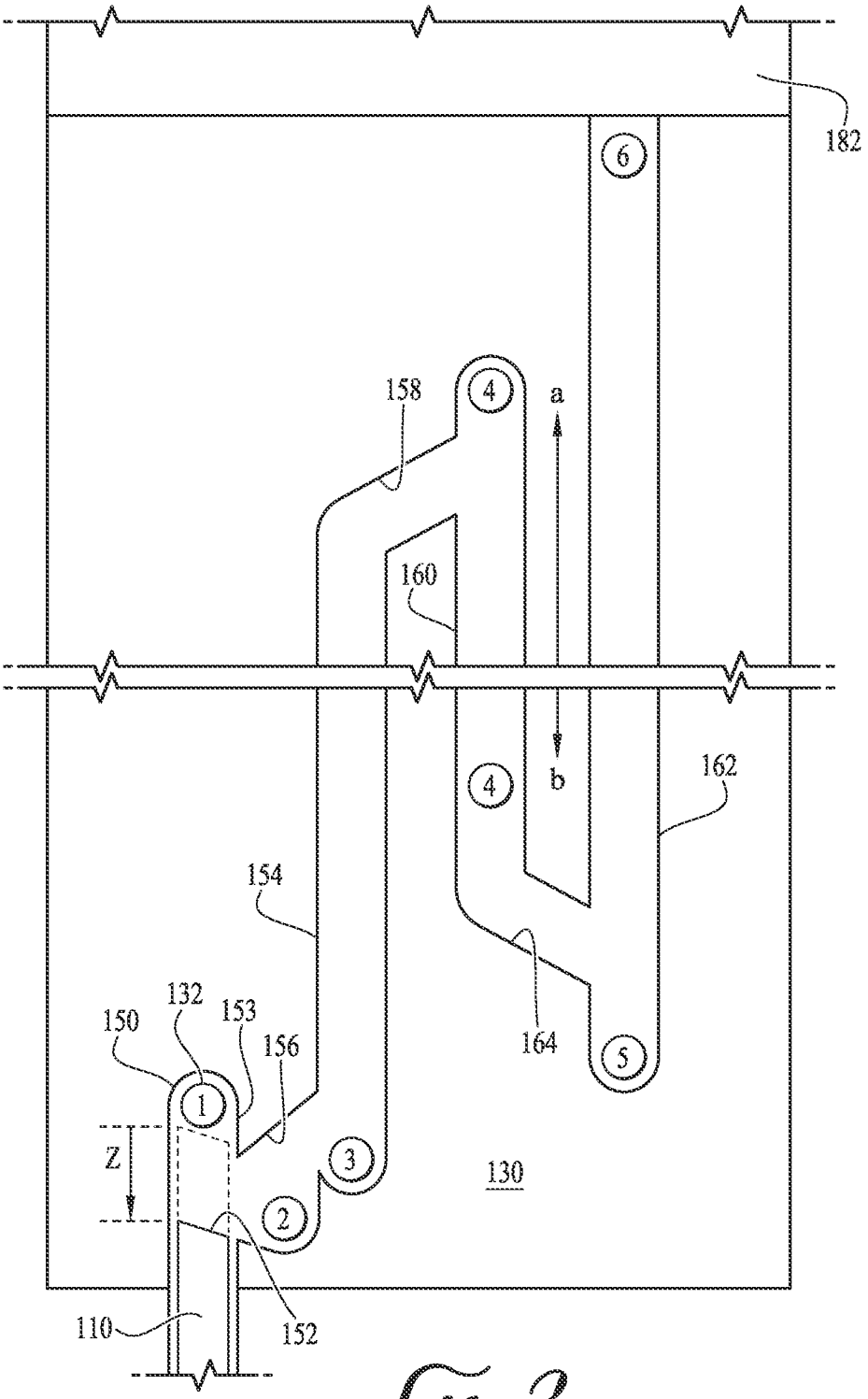
FIG. 3 is a plan view of an j-slot pattern on the block mandrel with the block lug positions according to an embodiment of the present invention.

The traveling block 104 can be retained in the run-in condition by the block release 102 until the release feature 115 on the block release 102 is activated. Turning now to FIG. 3, the j-slot 150 is illustrated as a flat surface for clarity in the description of the travel of the block lug 132. The j-slot 150 is formed along the outside surface of the block mandrel 130. Although one j-slot 150 and one block lug 132 is shown, it is understood that the traveling block 104 can include two, three, four, or more j-slots 150 and block lugs 132. The block lug 132 is shown in 6 positions within the j-slot 150 labeled with the numbers 1 through 5. It is understood that there is only one block lug 132 that moves from one numbered position to another numbered position. In position 1, also called the run-in position, the block lug 132 is labeled with number 1. In the run-in position, the block lug 132 can be retained in a first slot 153, also called a run-in slot 153, by the block lug lock 110. In the run-in position (e.g., position 1), the block lug lock 110 is in the run-in position blocking the block lug 132 from traveling within the j-slot. The block lug lock 110 shifts from a first position (e.g., run-in position) to the second position (e.g., release position) when the release feature 115 on the block release 102 is activated. The shift from the first position to the second position by the block lug lock 110 is illustrated by the letter Z. The block lug 132 can move within the j-slot when the block lug lock 110 is in the second position (e.g., release position). An upward movement of the work string will move the block lug 132 towards the lower end of the mandrel where the block release 102 is located. A downward movement of the work string will move the block lug 132 to the upper end of the mandrel where the lock release 106 is located. An upward movement of the work string can move the block lug 132 from position 1 (e.g., the run-in position) to position 2. The angled surface 152 of the block lug lock 110 rotates the lug rotator ring 134 within the block housing 136. A downward movement of the work string can move the block lug 132 into the second slot 154. The angled surface 156 can rotate the lug rotator ring 134 within the block housing 136 to align the block lug 132 with the second slot 154. An upward movement of the work string can move the block lug 132 to position 3. The block lug 132 can contact angled surface 158 and move into the third slot 160, also called a motion slot 160, and position 4 when the work string is lowered by the rig personnel. The block lug 132 can transfer from position "a" to position "b" in the motion slot 160 due to the wave motion of the floating rig also called rig heave. Lowering of the work string by the rig personnel will move the block lug into position 4, also labeled "a", in the motion slot 160. The rig personnel can lower the work string to add length to the work string with additional lengths of drill pipe or tubing. The rig personnel can also raise the work string extending into the wellbore a predetermined amount, then lower the work string to move the lug into position 4 in the motion slot 160. The work string will become stationary on the rig floor when the rig personnel set the work string in the slips to connect a subsequent length of work string. The wave motion of the floating rig will move the rig floor, and subsequently the work string, upward (e.g., raise) and downward (e.g., lower) relative to the casing while the work string is in the slips. The upward wave motion will move the block lug 132 to the lower position labeled "b" also called the second floating position. The downward wave motion will move the block lug 132 to the upper position 4 also labeled "a" also called the first floating position. The length of the travel from the first floating position "a" to the second floating position "b" can be referred to as the heave height. The length of the motion slot 160 can be greater than the heave height and can be predetermined to prevent wave motion from moving the block lug 132 to the fourth slot 162, also called the activating slot 162. The length of the motion slot 160 can be predetermined based on the historical wave height of the location of the floating rig. The block lug 132 can be moved from position 4 in the motion slot 160 to position 5 in the activating slot 162 by the rig personnel moving the work string upward a predetermined distance greater than the heave height or the distance from "a" to "b". The block lug 132 can contact an angled surface 164 to move into the activating slot 162 (e.g., fourth slot 162). The activating slot 162 can be a greater length than the motion slot 160 (e.g., third slot 160). The block lug 132 can travel up to position 6, also called the activating position, when the rig personnel lower the work string a predetermined distance greater than the heave height. The traveling block 104 contacts the lock release 106 to unlock the downhole tool 108 for actuation.

Although the j-slot 150 on the block mandrel 130 is described having three slots, it is understood that the j-slot 150 can have three, four, five, or any number of slots. In an aspect, the j-slot 150 does not have a position 2 as position 2 and position 3 are combined so that the block lug translates directly from the run-in position to position 3.

Figure 4A:
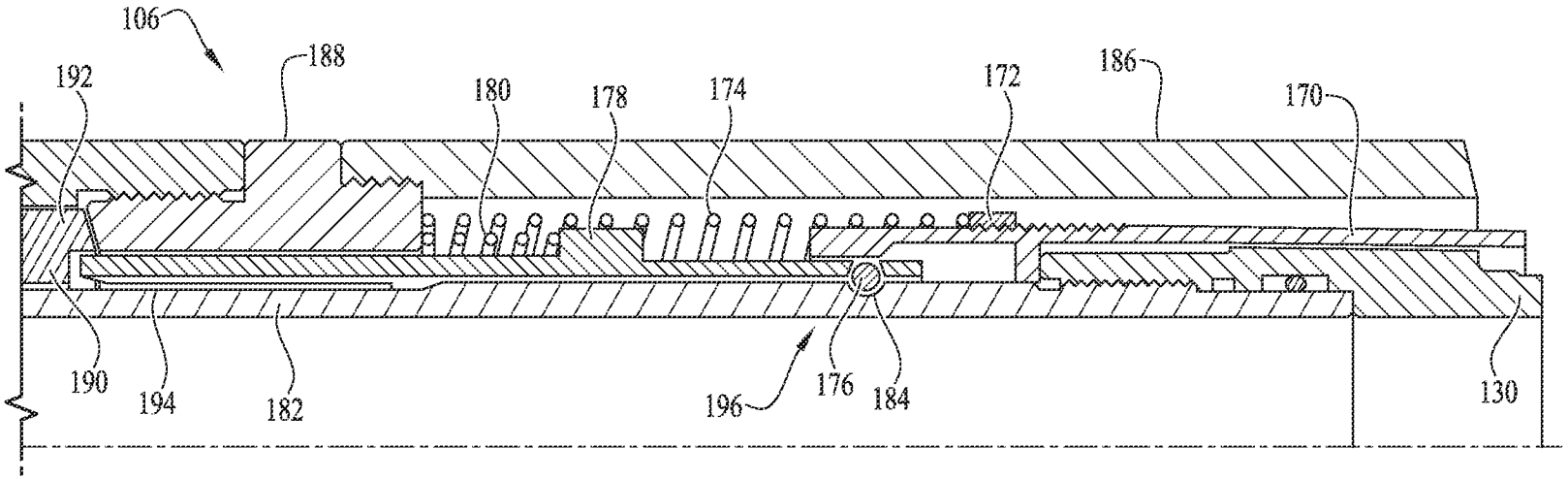
FIG. 4 A-B are sectional views of the lock release according to an embodiment of the present invention.

Turning now to FIG. 4A, the lock release 106 is described. The lock release 106 can comprise a trigger sleeve 170, a spring retainer 172, a trigger spring 174, a locking feature 196, a lug lock sleeve 178, a release spring 180, a release body 182, and a skirt 186. The lug lock sleeve 178 can be retained in a first position by the locking feature 196. The release feature can include a plurality of locking balls 176 installed through windows into a locking groove 184 on the release body 182. A trigger sleeve 170 can retain the locking feature 196, e.g., locking balls 176, within the locking groove 184. A release spring 180 installed between a bottom sub 188 and the lug lock sleeve 178 biases the lug lock sleeve 178 to move downward towards the block mandrel 130. A trigger spring 174 can be installed between the bottom sub 188 and a spring retainer 172 threadingly connected to the trigger sleeve 170 to bias the trigger sleeve 170 downwards towards the block mandrel 130. The skirt 186 can be threadingly connected to the bottom sub 188.

Figure 4B:
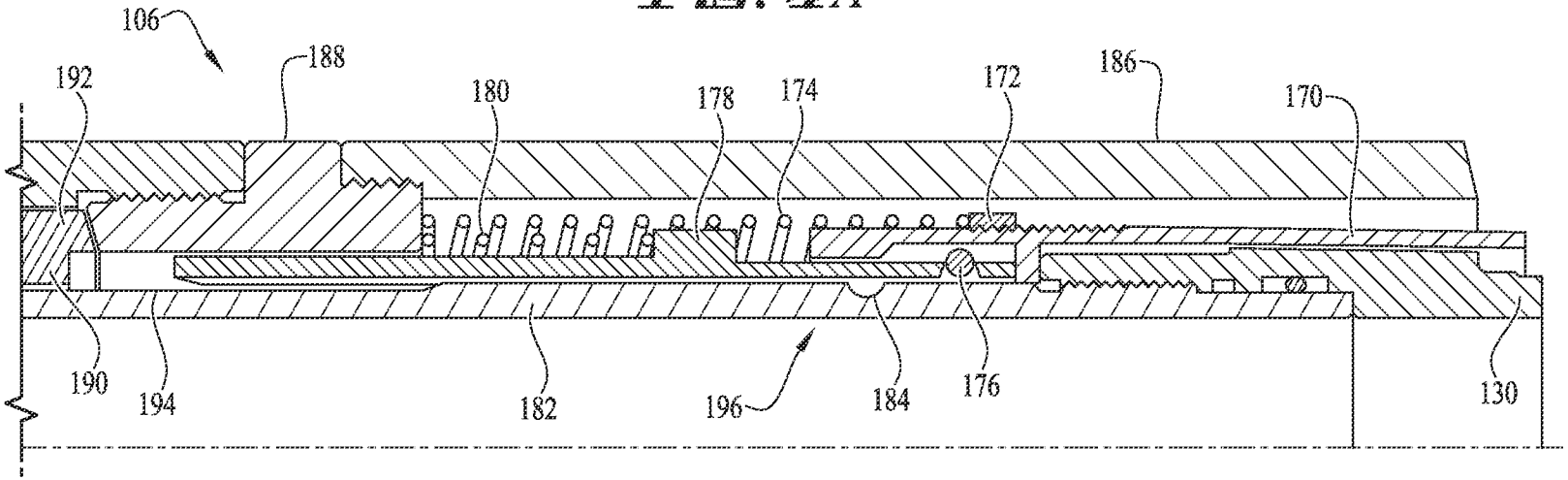

The lock release 106 can be activated by the traveling block 104 moving from position 5 to position 6 in FIG. 3 so that the top sub 142 (shown in FIG. 2) moves the trigger sleeve 170 to release the locking feature 196 (e.g., locking balls 176). The top sub 142 of the traveling block 104 contacts the trigger sleeve 170 and overcomes the spring force of the trigger spring 174 to move the trigger sleeve 170 from a first position covering the locking feature 196 (e.g., locking balls 176) to a second position uncovering the locking feature 196 (e.g., locking balls 176) by moving the trigger sleeve 170 towards the downhole tool 108. The locking balls 176 can move out of the locking groove 184 when the trigger sleeve is in the second position. As shown in FIG. 4B, the release spring 180 can then move the lug lock sleeve 178 towards the block mandrel 130 to a second position also called the release position. The skirt 186 may limit the travel of the traveling block 104 after the trigger sleeve 170 has moved to the second position. The release position of the lug lock sleeve 178 releases the lug 190 to move axially within a continuous j-slot 194 on the release body 182. A lug 190 can be part of a lug rotator ring 192 that allows for rotation of the lug 190 from a first slot position to a second slot position. The release of lug 190 by the lug lock sleeve 178 allows the downhole tool to activate.

In an embodiment, the trigger sleeve 170 may be held in place with shear pins. Shear pins may take the place of the trigger spring 174 to retain the trigger sleeve 170 in position to cover the locking balls 176. In an embodiment, the trigger sleeve 170 may have lug that extends into an indexing j-slot on the skirt 186. The lug may be move from a first position to a second position one or more times by the traveling block 104.

In an aspect, the locking feature 196 can be a single ended or doubled ended collet formed on the lug lock sleeve 178. The collet can extend into the locking groove 184 on the release body 182 and the trigger sleeve 170 can retain the collet in the locking groove 184 to retain the lug lock sleeve 178 in the first position. The single ended or doubled ended collet can flex radially outward and release from the locking groove 184 when the trigger sleeve 170 is moved to the release position. In an aspect, the locking feature 196 can be a c-ring held into the locking groove 184 by the trigger sleeve 170. The lug lock sleeve 178 can abut the c-ring in the locking groove 184. The c-ring can flex radially outward to release from the locking groove 184 when the trigger sleeve 170 is moved to the release position.

In an embodiment, the lug lock sleeve 178 may release a spring-loaded retention device to active a downhole tool. The release of the spring force can activate the downhole tool. In an embodiment, the downhole tool can be a perforating gun with a firing head activated to fire by the release of a spring mechanism.

Figures 5A, 5B, 5C:
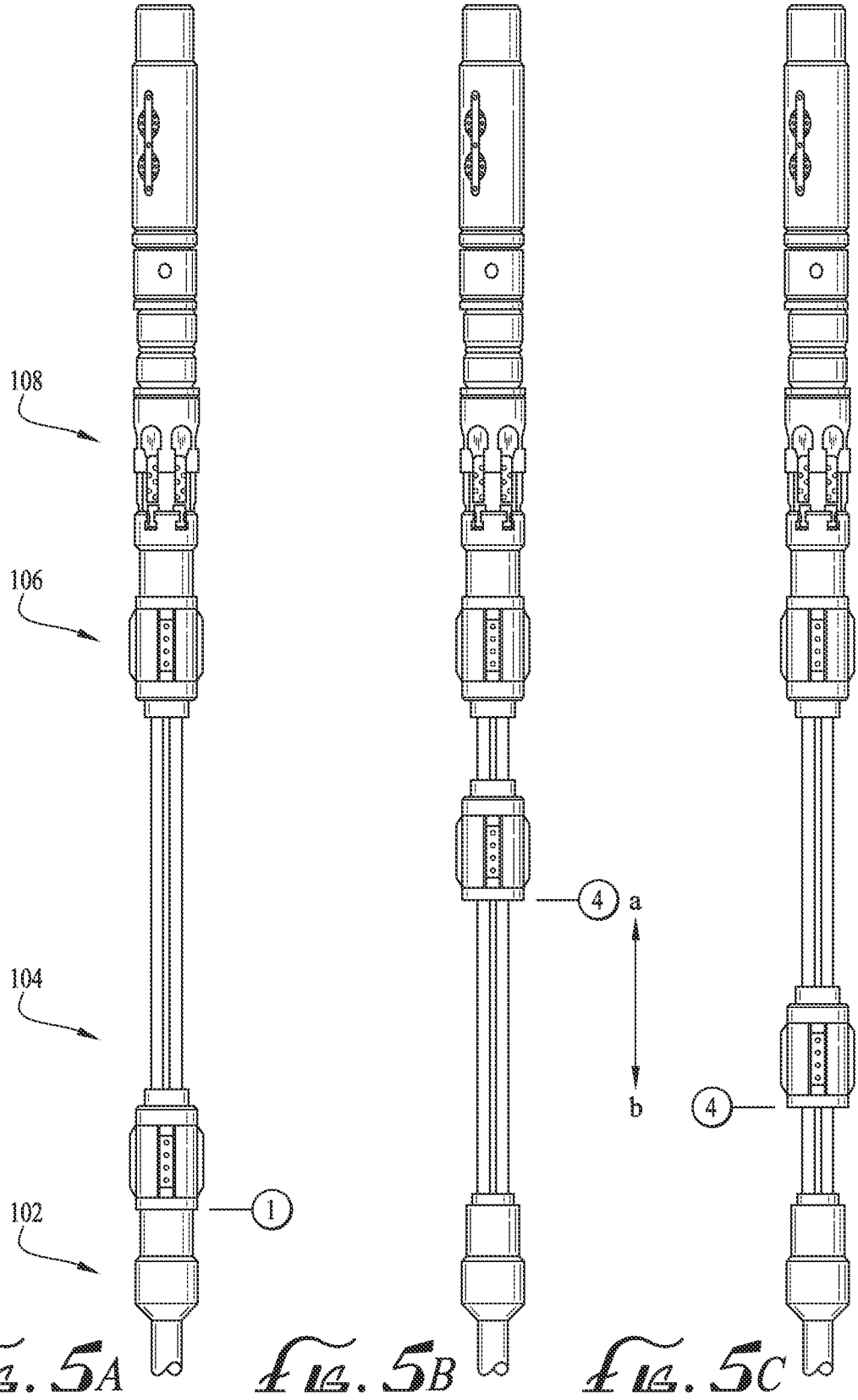
FIG. 5 A-E are side view drawings showing of the traveling block positions according to an embodiment of the present invention.

Turning now to FIG. 5A-E, the operational sequence for activating a downhole tool is described. In FIG. 5A, the downhole tool 108 can be held in the run-in position by a lock release 106 and a block release 102. The lock release 106 can retain the downhole tool 108 in the run-in position, as shown in FIG. 4, by retaining a lug 190 with a lug lock sleeve 178. A lug 190 of the downhole tool 108 activation system can be held in a run-in position by the lug lock sleeve 178 being retained in a first position by the trigger sleeve 170 retaining a plurality of locking balls 176 in a locking groove 184 on the release body 182.

Returning to FIG. 5A, the traveling block 104 can be held in the run-in position by a block release 102. As shown in FIG. 2 & FIG. 3, the block lug 132 can be held in the run-in position within a j-slot 150 of the block mandrel 130 by block lug lock 110. The position 1 of the block lug 132 is labeled with a number 1 on FIG. 3 and FIG. 5A. In the first position, the block lug 132 can be retained in a first pocket of the j-slot 150 by the block lug lock 110. The block lug lock 110 shifts from a first position to the second position, labeled with the letter Z, when the block release 102 is activated. A burst disk 114 (e.g., fluid stop 114) sealingly connected to a release chamber 112 can be broken when the hydrostatic pressure within the wellbore reaches a designated pressure. Wellbore fluids can fill the release chamber 112 to create a pressure differential with the activation chamber 116, generating a force to shear the shear pins 122 to push the lower housing 120, upper housing 118, and block lug lock 110 towards the end sub 128 and releasing the traveling block 104. The traveling block 104 can be free to move the subsequent positions 2, 3, and 4.

Although the fluid stop 114 is described as functioning as a rupture disk, any of the fluid stop 114 previously disclosed may be used.

Turning back to FIG. 5A-C, the traveling block 104 can move from position 1 shown on FIG. 5A to position 4 shown on FIG. 5B with the heave of the floating rig. As previously described in FIG. 3, the upward and downward wave motion of the floating rig can move the block lug 132 from position 1 (FIG. 5A) to position 4*a* (FIG. 5B) and 4*b* (FIG. 5C). In an example, an upward wave motion can move the block lug 132 from position 1 to position 2 (FIG. 3). A downward wave motion can move the block lug 132 from position 2 to a second slot 154. An upward movement from the wave or from the rig personnel can move the block lug 132 to position 3 in the second slot 154. A downward movement from the rig personnel can move the block lug 132 from the second slot 154 to position 4. The block lug 132 can move from position "a" to position "b", as shown in FIG. 5C, within the third slot 160 with wave motion of the floating rig. A downward movement from the rig personnel can return the block lug 132 to position 4 also labeled "a" position. The traveling block 104 can move from the "a" position to the "b" position until the rig personnel moves the traveling block 104 to position 5.

Figure 5D:
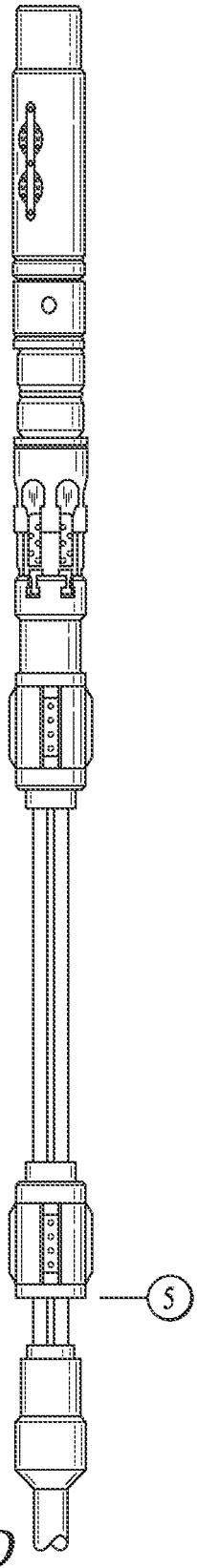
Figure 5E:
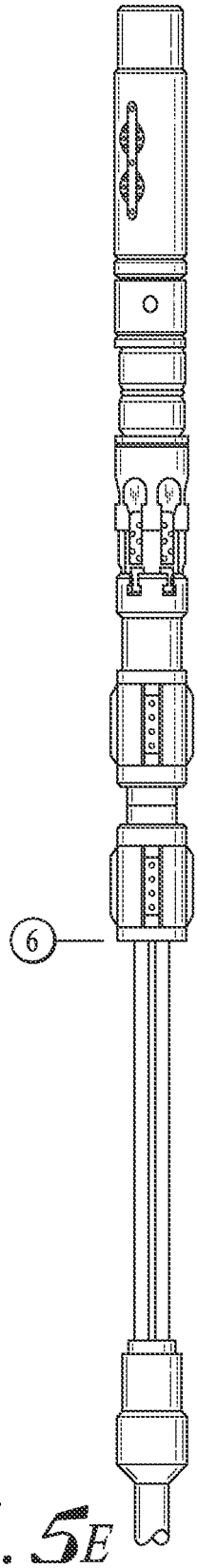

Turning now to FIG. 5D-E with reference to FIG. 3, the rig personnel can move the traveling block 104 from the second to the third slot. To position the traveling block 104 into the activating slot 162, the rig personnel can raise the work string a predetermined height to move the block lug 132 to position 5 in the activating slot 162. The predetermined height of the work string can be greater than the predetermined rig heave height. In FIG. 5E, the rig personnel can then lower the work string to move the pin from position 5 to position 6 where the traveling block 104 can contact the lock release 106.

Turning now to FIG. 4A-B, the traveling block 104 can contact the trigger sleeve 170. In position 6, the traveling block 104 can move the trigger sleeve 170 from a first position to a second position. The trigger sleeve 170 uncovers the locking balls 176 to release them from the locking groove 184 on the release body 182. The lug lock sleeve 178 can then move from a first position in FIG. 4A to a second position in FIG. 4B to release the lug 190. The lug 190 can move within a continuous j-slot 194 of the release body 182 to activate the downhole tool 108.

The downhole tool 108 can be activated with further work string motion from the rig personnel. Although the downhole tool 108 activation is described as work string motion, it is understood that the downhole tool 108 can be activated by rupture disk, pressure applied down the work string, hydrostatic chamber, residual spring force, or any other setting mechanism.

Figure 6:
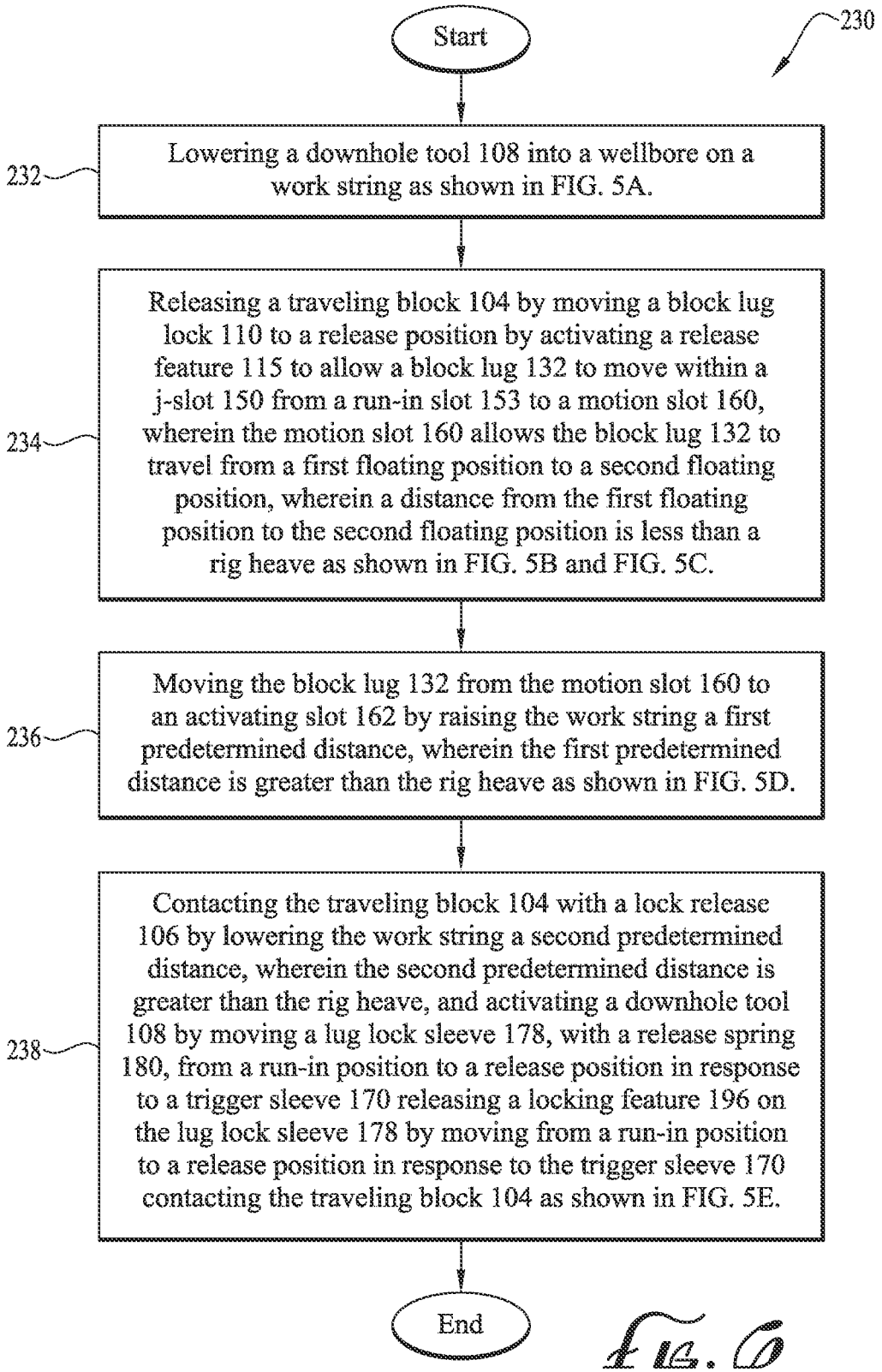
FIG. 6 is a flow chart of a method of activating a downhole tool assembly according to an embodiment of the disclosure.

Turning now to FIG. 6, a method 230 is described. In an embodiment, the method 230 is a method of activating a downhole tool assembly. At block 232, the method 230 comprises lowering a downhole tool 108 into a wellbore on a work string as shown in FIG. 5A.

At block 234, the method 230 comprises releasing a traveling block 104 by moving a block lug lock 110 to a release position by activating a release feature 115 to allow a block lug 132 to move within a j-slot 150 from a run-in slot 153 to a motion slot 160, wherein the motion slot 160 allows the block lug 132 to travel from a first floating position to a second floating position, wherein a distance from the first floating position to the second floating position is less than a rig heave as shown in FIG. 5B and FIG. 5C.

At block 236, the method 230 comprises moving the block lug 132 from the motion slot 160 to an activating slot 162 by raising the work string a first predetermined distance, wherein the first predetermined distance is greater than the rig heave as shown in FIG. 5D.

At block 238, the method 230 comprises contacting the traveling block 104 with a lock release 106 by lowering the work string a second predetermined distance, wherein the second predetermined distance is greater than the rig heave, and activating a downhole tool 108 by moving a lug lock sleeve 178, with a release spring 180, from a run-in position to a release position in response to a trigger sleeve 170 releasing a locking feature 196 on the lug lock sleeve 178 by moving from a run-in position to a release position in response to the trigger sleeve 170 contacting the traveling block 104 as shown in FIG. 5E.

Figure 7:
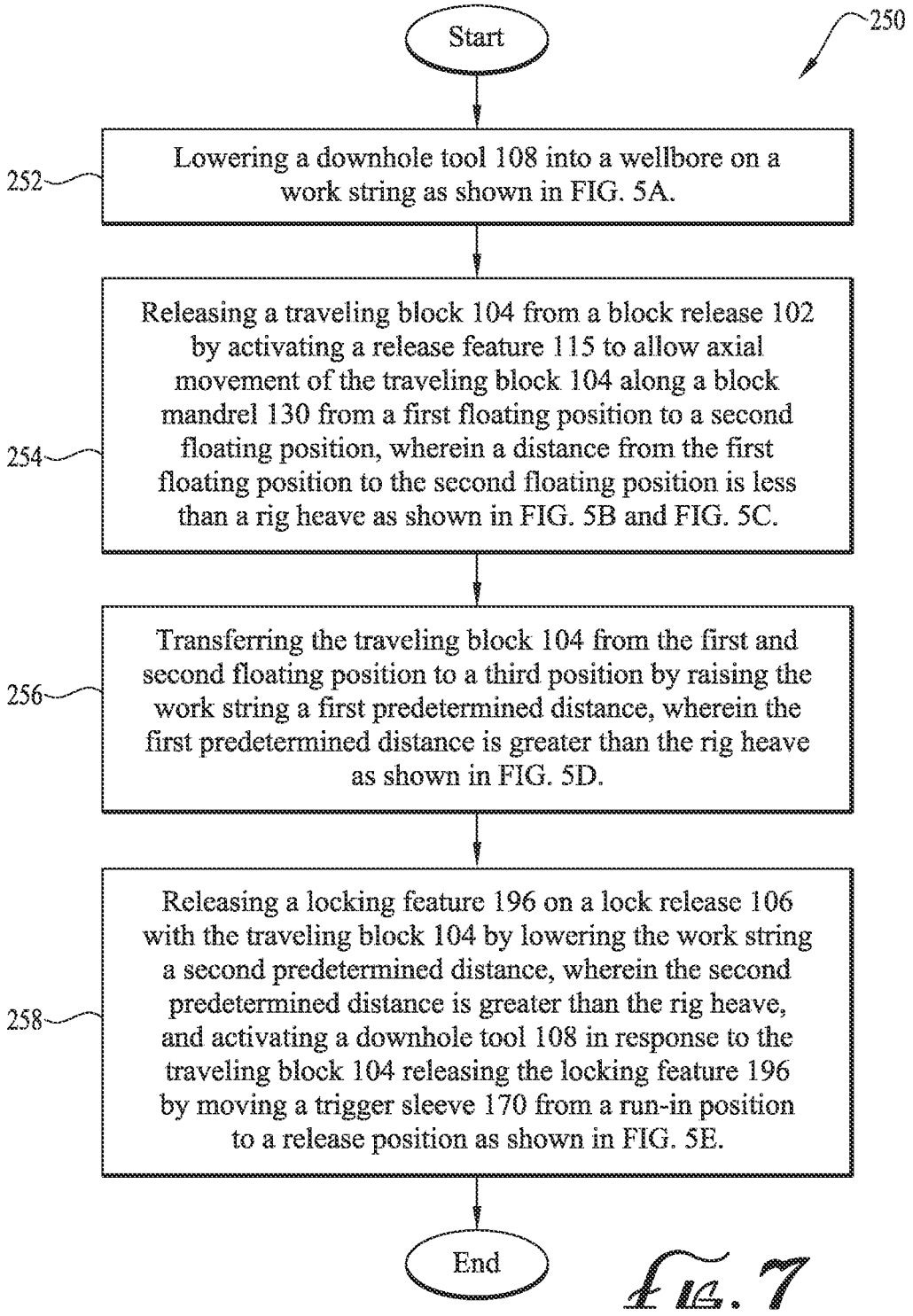
FIG. 7 is a flow chart of another method of activating a downhole tool assembly according to an embodiment of the disclosure.

Turning now to FIG. 7, a method 250 is described. In an embodiment, the method 250 is a method of activating a downhole tool assembly. At block 252, the method 250 comprises lowering a downhole tool 108 into a wellbore on a work string as shown in FIG. 5A.

At block 254, the method 250 comprises releasing a traveling block 104 from a block release 102 by activating a release feature 115 to allow axial movement of the traveling block 104 along a block mandrel 130 from a first floating position to a second floating position, wherein a distance from the first floating position to the second floating position is less than a rig heave as shown in FIG. 5B and FIG. 5C.

At block 256, the method 250 comprises transferring the traveling block 104 from the first and second floating position to a third position by raising the work string a first predetermined distance, wherein the first predetermined distance is greater than the rig heave as shown in FIG. 5D.

At block 258, the method 250 comprises releasing a locking feature 196 on a lock release 106 with the traveling block 104 by lowering the work string a second predetermined distance, wherein the second predetermined distance is greater than the rig heave, and activating a downhole tool 108 in response to the traveling block 104 releasing the locking feature 196 by moving a trigger sleeve 170 from a run-in position to a release position as shown in FIG. 5E.

Additional Disclosure

The following are non-limiting, specific embodiments in accordance with the present disclosure:

A first embodiment, which is a downhole tool activation assembly, comprising a block release 102 comprising an end sub 128 threadingly connected to a lower mandrel 124 with a release feature 115 sealingly coupled to the lower mandrel 124, wherein the release feature 115 comprises a release chamber 112, an activation chamber 116, and a fluid stop 114, wherein a block lug lock 110 is coupled to the release feature 115 in a first position, and wherein the release feature 115 is configured to move the block lug lock 110 to a release position when activated, and a traveling block 104 comprising a plurality of drag blocks 138 and drag block springs 140 configured to retain the traveling block 104 to a position along an inner surface of a casing, a block mandrel 130 connected to the lower mandrel 124, a lug rotator ring 134 configured to move axially relative to the block mandrel 130, and a block lug 132 connected to the lug rotator ring 134 configured to move within a j-slot 150 on the block mandrel 130 in response to the block lug lock 110 moving to the release position, wherein the j-slot 150 includes a run-in slot 153, a motion slot 160, and an activating slot 162, wherein the block lug 132 is retained in the run-in slot 153 by the block lug lock 110, wherein the run-in slot 153 is configured to transfer the block lug 132 from a first position to the motion slot 160, wherein the motion slot 160 is configured to transfer the block lug 132 to the activating slot 162, and wherein the activating slot 162 configured to move the block lug 132 to an activating position.

A second embodiment, which is the downhole tool activation assembly of the first embodiment, further comprising a lock release 106 comprising a lug lock sleeve 178 with a locking feature 196 configured to retain the lug lock sleeve 178 in a run-in position relative to a locking groove 184, and a trigger sleeve 170 configured to retain the locking feature 196 in a locking groove 184 in a first position and release the locking feature 196 in a second position, wherein the lug lock sleeve 178 is configured to prevent an activation of a downhole tool 108 in the first position and allow the activation of the downhole tool 108 in a second position.

A third embodiment, which is the downhole tool activation assembly of the second embodiment, further comprising the downhole tool 108, wherein the downhole tool comprises a release body 182 having a continuous j-slot 194, a lug rotator ring 192 configured to move axially relative to the release body 182, a lug 190 configured to move within the continuous j-slot, and a first lug position and a second lug position, wherein the second lug position activates the downhole tool.

A fourth embodiment, which is the downhole tool activation assembly of the third embodiment, wherein the downhole tool 108 is activated in response to a lug lock sleeve 178 moving to a second position in response to the locking feature 196 moving to a release position in response to the traveling block 104 moving the trigger sleeve 170 to a second position.

A fifth embodiment, which is the downhole tool activation assembly of any of the first through the fourth embodiments, wherein the fluid stop 114 comprises one of i) a rupture disk, ii) a dissolvable plug, or iii) a Kobe plug.

A sixth embodiment, which is the downhole tool activation assembly of any of the second through the fifth embodiments, wherein the locking feature 196 comprises one of i) a plurality of locking balls, ii) a collet, or iii) a c-ring located in a locking groove on a release body and wherein the trigger sleeve 170 is configured to release the locking feature 196 from a run-in position when the trigger sleeve 170 is moved to a second position.

A seventh embodiment, which is the downhole tool activation assembly of any of the first through the sixth embodiments, wherein rig heave does not transfer the block lug 132 from the motion slot 160.

An eighth embodiment, which is the downhole tool activation assembly of any of the first through the seventh embodiments, wherein upward motion of a work string transfers the block lug 132 from the motion slot 160 to the activating slot 162.

A ninth embodiment, which is the downhole tool activation assembly of the eighth embodiment, wherein downward motion of the work string moves the block lug 132 to the activating position.

A tenth embodiment, which is the downhole tool activation assembly of any of the first through the ninth embodiments, wherein the downhole tool 108 is one of a retrievable packer, a permanent packer, a bridge plug, a circulation valve, an isolation valve, a downhole tester, a perforating gun assembly, or any other activatable downhole tool assembly.

An eleventh embodiment, which is a method of activating a downhole tool assembly, comprising [FIG. 5A] lowering a downhole tool 108 into a wellbore on a work string, [FIG. 5 B/C] releasing a traveling block 104 by moving a block lug lock 110 to a release position by activating a release feature 115 to allow a block lug 132 to move within a j-slot 150 from a run-in slot 153 to a motion slot 160, wherein the motion slot 160 allows the block lug 132 to travel from a first floating position to a second floating position, wherein a distance from the first floating position to the second floating position is less than a rig heave, [FIG. 5D] moving the block lug 132 from the motion slot 160 to an activating slot 162 by raising the work string a first predetermined distance, wherein the first predetermined distance is greater than the rig heave, [FIG. 5E] contacting the traveling block 104 with a lock release 106 by lowering the work string a second predetermined distance, wherein the second predetermined distance is greater than the rig heave, and activating a downhole tool 108 by moving a lug lock sleeve 178, with a release spring 180, from a run-in position to a release position in response to a trigger sleeve 170 releasing a locking feature 196 on the lug lock sleeve 178 by moving from a run-in position to a release position in response to the trigger sleeve 170 contacting the traveling block 104.

A twelfth embodiment, which is the method of the eleventh embodiment, wherein activating a downhole tool comprises one of i) moving a lug in a j-slot from a first position to a second position by raising and lowering the work string, wherein the lug lock sleeve allows the lug to move in the j-slot in the release position, or ii) releasing a spring-loaded firing head.

A thirteenth embodiment, which is the method of the eleventh or the twelfth embodiment, wherein activating a release feature comprises rupturing a rupture disk with hydrostatic pressure to move the block lug lock to a second position.

A fourteenth embodiment, which is a downhole tool activation assembly, comprising a traveling block 104 comprising a plurality of drag blocks 138 and drag block springs 140 configured to retain the traveling block 104 to a position along an inner surface of a casing while allowing axial travel along a block mandrel 130, a block release 102 connected to the block mandrel 130 and configured to retain the traveling block 104 in a first position adjacent to the block release 102 by a release feature 115, a lock release 106 connected to the block mandrel 130 and configured to retain a downhole tool 108 in a run-in position with a locking feature 196, wherein the traveling block 104 is configured to travel axially from a first floating position to a second floating position relative to the block mandrel 130 in response to activation of the release feature 115.

A fifteenth embodiment, which is the downhole tool activation assembly of the fourteenth embodiment, wherein a distance from the first floating position to the second floating position is less than a rig heave.

A sixteenth embodiment, which is the downhole tool activation assembly of the fourteenth or the fifteenth embodiment, wherein the traveling block 104 is transferable to an activating position adjacent to the lock release 106.

A seventeenth embodiment, which is the downhole tool activation assembly of the sixteenth embodiment, wherein the lock release 106 is configured to activate a downhole tool 108 in response to the traveling block 104 moving to the activating position and deactivating the locking feature 196.

An eighteenth embodiment, which is the downhole tool activation assembly of any of the fourteenth through the seventeenth embodiments, wherein the lock release 106 comprises a lug lock sleeve 178 with a locking feature 196 configured to retain the lug lock sleeve 178 in a run-in position relative to a locking groove 184, and a trigger sleeve 170 configured to retain the locking feature 196 in a locking groove 184 in a first position and release the locking feature 196 in a second position, wherein the lug lock sleeve 178 is configured to prevent an activation of a downhole tool 108 in the first position and allow the activation of the downhole tool 108 in a second position.

A nineteenth embodiment, which is the downhole tool activation assembly of the eighteenth embodiment, wherein the downhole tool 108 is activated in response to a lug lock sleeve 178 moving to a second position in response to the locking feature 196 moving to a release position in response to the traveling block 104 moving the trigger sleeve 170 to a second position.

A twentieth embodiment, which is the downhole tool activation assembly of the eighteenth embodiment, wherein the locking feature 196 comprises one of i) a plurality of locking balls, ii) a collet, or iii) a c-ring located in a locking groove on a release body and wherein the trigger sleeve 170 is configured to release the locking feature 196 from a run-in position when the trigger sleeve 170 is moved to a second position.

A twenty-first embodiment, which is the downhole tool activation assembly of any of the fourteenth through the twentieth embodiments, wherein the traveling block 104 is released from the block release 102 in response to activation of the release feature 115, wherein the block release 102 comprises a lower mandrel 124 connected to the block mandrel 130 with the release feature 115 sealingly coupled to the lower mandrel 124, wherein the release feature 115 comprises a release chamber 112, an activation chamber 116, a fluid stop 114, and a block lug lock 110, wherein the block lug lock 110 retains the traveling block 104 in a first position, and wherein the release feature 115 is configured to move the block lug lock 110 to a release position when activated, and wherein upward motion of a work string a distance greater than the rig heave transfers the traveling block 104 from the first and second floating positions to the third position, and the traveling block 104 moves to the activating position adjacent to the lock release 106 in response to downward motion of the work string.

A twenty-second embodiment, which is the downhole tool activation assembly of the twenty-first embodiment, wherein the fluid stop 114 comprises one of i) a rupture disk, ii) a dissolvable plug, or iii) a Kobe plug.

A twenty-third embodiment, which is the downhole tool activation assembly of the twenty-first or the twenty-second embodiment, wherein the traveling block 104 further comprises a block lug 132 connected to a lug rotator ring 134 and a j-slot 150 on the block mandrel 130, wherein the block lug 132 is configured to move within the j-slot 150 while the traveling block 104 is configured to move axially relative to the block mandrel 130, wherein the traveling block 104 is retained in the first position when the block lug 132 is retained in a run-in slot 153 by the block lug lock 110, wherein the traveling block 104 travels axially from the first floating position to the second floating position when the block lug 132 is within a motion slot 160, wherein upward motion of the work string a distance greater than the rig heave transfers the block lug 132 from the motion slot 160 to an activating slot 162, and wherein downward motion of the work string moves the block lug 132 to the activating position.

A twenty-fourth embodiment, which is the downhole tool activation assembly of the twenty-third embodiment, wherein the run-in slot 153 is configured to transfer the block lug 132 from a first position to the motion slot 160, wherein the motion slot 160 is configured to transfer the block lug 132 to the activating slot 162, and wherein the activating slot 162 configured to move the block lug 132 to an activating position.

A twenty-fifth embodiment, which is the downhole tool activation assembly of any of the fourteenth through the twenty-fourth embodiments, wherein the downhole tool comprises a release body 182 having a continuous j-slot 194, a lug rotator ring 192 configured to move axially relative to the release body 182, a lug 190 configured to move within the continuous j-slot, and a first lug position and a second lug position, wherein the second lug position activates the downhole tool.

A twenty-sixth embodiment, which is the downhole tool activation assembly of any of the fourteenth through the twenty-fifth embodiments, wherein the downhole tool 108 is one of a retrievable packer, a permanent packer, a bridge plug, a circulation valve, an isolation valve, a downhole tester, a perforating gun assembly, or any other activatable downhole tool assembly.

A twenty-seventh embodiment, which is a method of activating a downhole tool assembly, comprising [FIG. 5A] lowering a downhole tool 108 into a wellbore on a work string, [FIG. 5 B/C] releasing a traveling block 104 from a block release 102 by activating a release feature 115 to allow axial movement of the traveling block 104 along a block mandrel 130 from a first floating position to a second floating position, wherein a distance from the first floating position to the second floating position is less than a rig heave, [FIG. 5D] transferring the traveling block 104 from the first and second floating position to a third position by raising the work string a first predetermined distance, wherein the first predetermined distance is greater than the rig heave, [FIG. 5E] releasing a locking feature 196 on a lock release 106 with the traveling block 104 by lowering the work string a second predetermined distance, wherein the second predetermined distance is greater than the rig heave, and activating a downhole tool 108 in response to the traveling block 104 releasing the locking feature 196 by moving a trigger sleeve 170 from a run-in position to a release position.

A twenty-eighth embodiment, which is the method of the twenty-seventh embodiment, wherein activating the downhole tool comprises one of i) moving a lug in a j-slot from a first position to a second position by raising and lowering the work string, wherein the lug lock sleeve allows the lug to move in the j-slot in the release position, or ii) releasing a spring-loaded firing head.

A twenty-ninth embodiment, which is the method of the twenty-seventh or the twenty-eighth embodiment, wherein activating a release feature 115 comprises rupturing a rupture disk with hydrostatic pressure to move the release feature 115 to a second position.

A thirtieth embodiment, which is the method of the twenty-seven, the twenty-eighth or the twenty-ninth embodiment, wherein the downhole tool 108 is one of a retrievable packer, a permanent packer, a bridge plug, a circulation valve, an isolation valve, a downhole tester, a perforating gun assembly, or any other activatable downhole tool assembly.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A downhole tool activation assembly, comprising:

a block release comprising an end sub threadingly connected to a lower mandrel with a release feature sealingly coupled to the lower mandrel, wherein the release feature comprises a release chamber, an activation chamber, and a fluid stop, wherein a block lug lock is coupled to the release feature in a first position, and wherein the release feature is configured to move the block lug lock to a release position when activated; and a traveling block comprising a plurality of drag blocks and drag block springs configured to retain the traveling block to a position along an inner surface of a casing, a block mandrel connected to the lower mandrel, a lug rotator ring configured to move axially relative to the block mandrel, and a block lug connected to the lug rotator ring configured to move within a j-slot on the block mandrel in response to the block lug lock moving to the release position;

wherein the j-slot includes a run-in slot, a motion slot, and an activating slot, wherein the block lug is retained in the run-in slot by the block lug lock, wherein the run-in slot is configured to transfer the block lug from a first position to the motion slot, wherein the motion slot is configured to transfer the block lug to the activating slot, and wherein the activating slot configured to move the block lug to an activating position.

2. The downhole tool activation assembly of claim 1, further comprising a lock release comprising:

a lug lock sleeve with a locking feature configured to retain the lug lock sleeve in a run-in position relative to a locking groove, and a trigger sleeve configured to retain the locking feature in a locking groove in a first position and release the locking feature in a second position, wherein the lug lock sleeve is configured to prevent an activation of a downhole tool in the first position and allow the activation of the downhole tool in a second position.

3. The downhole tool activation assembly of claim 2, further comprising a downhole tool, wherein the downhole tool comprises a release body having a continuous j-slot, a lug rotator ring configured to move axially relative to the release body, a lug configured to move within the continuous j-slot, and a first lug position and a second lug position, wherein the second lug position activates the downhole tool.

4. The downhole tool activation assembly of claim 3, wherein the downhole tool is activated in response to a lug lock sleeve moving to a second position in response to the locking feature moving to a release position in response to the traveling block moving the trigger sleeve to a second position.

5. The downhole tool activation assembly of claim 3, wherein the downhole tool is one of a retrievable packer, a permanent packer, a bridge plug, a circulation valve, an isolation valve, a downhole tester, a perforating gun assembly, or any other activatable downhole tool assembly.

6. The downhole tool activation assembly of claim 2, wherein the locking feature comprises one of i) a plurality of locking balls, ii) a collet, or iii) a c-ring located in a locking groove on a release body and wherein the trigger sleeve is configured to release the locking feature from a run-in position when the trigger sleeve is moved to a second position.

7. The downhole tool activation assembly of claim 1, wherein the fluid stop comprises one of i) a rupture disk, ii) a dissolvable plug, or iii) a Kobe plug.

8. The downhole tool activation assembly of claim 1, wherein rig heave does not transfer the block lug from the motion slot.

9. The downhole tool activation assembly of claim 1, wherein upward motion of a work string transfers the block lug from the motion slot to the activating slot.

10. The downhole tool activation assembly of claim 9, wherein downward motion of the work string moves the block lug to the activating position.

11. A method of activating a downhole tool assembly, comprising:

lowering a downhole tool into a wellbore on a work string; and releasing a traveling block by moving a block lug lock to a release position by activating a release feature to allow a block lug to move within a j-slot from a run-in slot to a motion slot, wherein the motion slot allows the block lug to travel from a first floating position to a second floating position, wherein a distance from the first floating position to the second floating position is less than a rig heave.

12. The method of claim 11 further comprising moving the block lug from the motion slot to an activating slot by raising the work string a first predetermined distance, wherein the first predetermined distance is greater than the rig heave.

13. The method of claim 12 further comprising contacting the traveling block with a lock release by lowering the work string a second predetermined distance, wherein the second predetermined distance is greater than the rig heave.

14. The method of claim 13 further comprising activating a downhole tool by moving a lug lock sleeve, with a release spring, from a run-in position to a release position in response to a trigger sleeve releasing a locking feature on the lug lock sleeve by moving from a run-in position to a release position in response to the trigger sleeve contacting the traveling block.

15. The method of claim 14, wherein:

activating a downhole tool comprises one of i) moving a lug in a j-slot from a first position to a second position by raising and lowering the work string, wherein the lug lock sleeve allows the lug to move in the j-slot in the release position, or ii) releasing a spring-loaded firing head.

16. The method of claim 15, wherein:

activating a release feature comprises rupturing a rupture disk with hydrostatic pressure to move the block lug lock to a second position.

17. A method of activating a downhole tool assembly, comprising:

lowering a downhole tool into a wellbore on a work string;

releasing a traveling block from a block release by activating a release feature to allow axial movement of the traveling block along a block mandrel from a first floating position to a second floating position, wherein a distance from the first floating position to the second floating position is less than a rig heave;

transferring the traveling block from the first and second floating position to a third position by raising the work string a first predetermined distance, wherein the first predetermined distance is greater than the rig heave;

releasing a locking feature on a lock release with the traveling block by lowering the work string a second predetermined distance, wherein the second predetermined distance is greater than the rig heave; and activating a downhole tool in response to the traveling block releasing the locking feature by moving a trigger sleeve from a run-in position to a release position.

18. The method of claim 17, wherein:

activating the downhole tool comprises one of i) moving a lug in a j-slot from a first position to a second position by raising and lowering the work string, wherein a lug lock sleeve allows the lug to move in the j-slot in the release position, or ii) releasing a spring-loaded firing head.

19. The method of claim 18, wherein:

activating a release feature comprises rupturing a rupture disk with hydrostatic pressure to move the release feature to a second position.

20. The method of claim 19, wherein the downhole tool is one of a retrievable packer, a permanent packer, a bridge plug, a circulation valve, an isolation valve, a downhole tester, a perforating gun assembly, or any other activatable downhole tool assembly.

* * * * *